US005267424A

United States Patent [19]

Douglas

[11] Patent Number: 5,267,424

[45] Date of Patent: Dec. 7, 1993

[54] MODULE FOR AN ARTICULATED STOWABLE AND DEPLOYABLE MAST

[75] Inventor: Mark V. Douglas, Santa Barbara, Calif.

[73] Assignee: AEC-Able Engineering Co., Inc., Goleta, Calif.

[21] Appl. No.: 866,029

[22] Filed: Apr. 9, 1992

[51] Int. Cl.[5] ..... E04H 12/18

[52] U.S. Cl. ..... 52/646; 52/108; 52/111; 52/653.2; 24/129 R; 24/128

[58] Field of Search ..... 52/108, 111, 646, 648; 403/74; 24/115 R, 129 R, 129 B, 128, 114.5

[56] References Cited

U.S. PATENT DOCUMENTS

| | | | |
|---|---|---|---|
| 979,588 | 12/1910 | Stewart | 24/129 |
| 2,982,379 | 5/1961 | Fisher | 52/111 |
| 3,335,468 | 8/1967 | Harley | 24/128 R |
| 3,988,810 | 11/1976 | Emery | 24/128 R |
| 4,475,323 | 10/1984 | Schwartzberg et al. | 52/646 |
| 4,599,832 | 7/1986 | Benton et al. | 52/646 |
| 5,016,418 | 5/1991 | Rhodes et al. | 52/646 |

FOREIGN PATENT DOCUMENTS

| | | | |
|---|---|---|---|
| 0972811 | 2/1951 | France | 52/111 |

*Primary Examiner*—Carl D. Friedman
*Assistant Examiner*—Winnie Yip
*Attorney, Agent, or Firm*—Donald D. Mon

[57] ABSTRACT

A module for forming part of an articulated mast which can be retracted to be stowed and elongated to be deployed, the mast when deployed having a central axis of elongation and a plurality of these modules. Each module has at least three rigid non-folding station rods joined to form a rigid station, and an equal number of non-folding longerons, each hingedly connected to a corner of the station. Four diagonal segments are formed as part of two flexible inelastic cables, which are brought together at a control which always holds one of the cables, and passes the other. The control includes a releasable catch to hold the other cable when its segments are at lengths respective to a deployed module.

5 Claims, 4 Drawing Sheets

MODULE FOR AN ARTICULATED STOWABLE AND DEPLOYABLE MAST

FIELD OF THE INVENTION

This invention relates to masts which can be stowed in a compact configuration and extended to a rigid, elongated deployed configuration.

BACKGROUND OF THE INVENTION

Masts are known which can be extended to a rigid deployed configuration and which can be stowed in a compact configuration. Depending on their application they may or may not be equipped with means to retract them to their stowed position once they have been deployed.

Masts of this type generally have a plurality of station members (sometimes called "battens") which when the mast is deployed lie in a plane normal to the axis of the deployed mast. At least three longerons are provided which extend axially between adjacent station members when the mast is deployed. The longerons and station members form a plurality of axially aligned open bays, and when the structure forming the bays is stabilized, the mast becomes a rigid structure which can be used to support next assemblies such as antennas or solar cells.

Masts can not usually be transported in their deployed configuration, and are therefore made retractable to a compact stowed configuration which can readily be transported. Such masts are the subject of numerous patents, for example Benton et al U.S. Pat. No. 4,599,832. This Benton patent has enjoyed considerable acceptance, but requires flexible springing elements to maintain the bays in their rigid condition. Because these masts find frequent application where weight and bulk are a disadvantage, it is a desirable objective to reduce the number of parts required for the device, which this invention achieves.

BRIEF DESCRIPTION OF THE INVENTION

A mast according to this invention comprises a plurality of identical modules which are connected one above the other when the mast is deployed. Each module includes a pair of rigid station elements, sometimes called battens. These are rigid structures formed from at least three rigid station rods, joined together to form a polygon by rigid joinders at the corners formed by adjacent rods. When the mast is deployed, the polygons lie in planes normal to the extended axis.

A plurality of rigid longerons are interconnected between respective corners of adjacent station elements. Their connections at these corners permit rotation around an axis normal to the plane, and also around another axis parallel to the plane. The longerons are thereby swivelly and tiltably connected to the respective corners of its two adjacent station members.

The station elements and longerons, when the mast is deployed, form a plurality of bays, one between each pair of opposed station rods and longerons. In each bay there are provided four diagonal segments. These segments are made of inelastic flexible material, preferably a cable. Each segment is connected to a respective corner of a station element.

A diagonal control means is disposed in each bay. Two adjacent segments are fixed to the control means and each segment has a fixed inherent length which does not change. The other two segments are continuous with each other, and are slidably fitted in the control means. When the mast is erected, the lengths of all segments are equal. The control means is disposed at the center of the bay, and the control means catches the second two segments and holds them against sliding through the control means. The bays are then rigid, and so is the module.

When the control means is released and the station elements are brought toward one another, some cable from one segment of the second two segments passes through the control means to form part of the other segment of the second two segments, which thereby lengthens the total length of two aligned diagonal segments to permit the bay to assume a parallelogram configuration, and the station members can be brought toward each other in the stowed configuration. The other two diagonal segments collapse.

According to a preferred but optional feature of the invention one of the second two of the segments carries a protuberance which is gripped by the control means to hold the diagonals in the deployed condition.

The above and other features of this invention will be fully understood from the following detailed description and the accompanying drawings, in which:

DETAILED DESCRIPTION OF THE INVENTION

Figure 1:
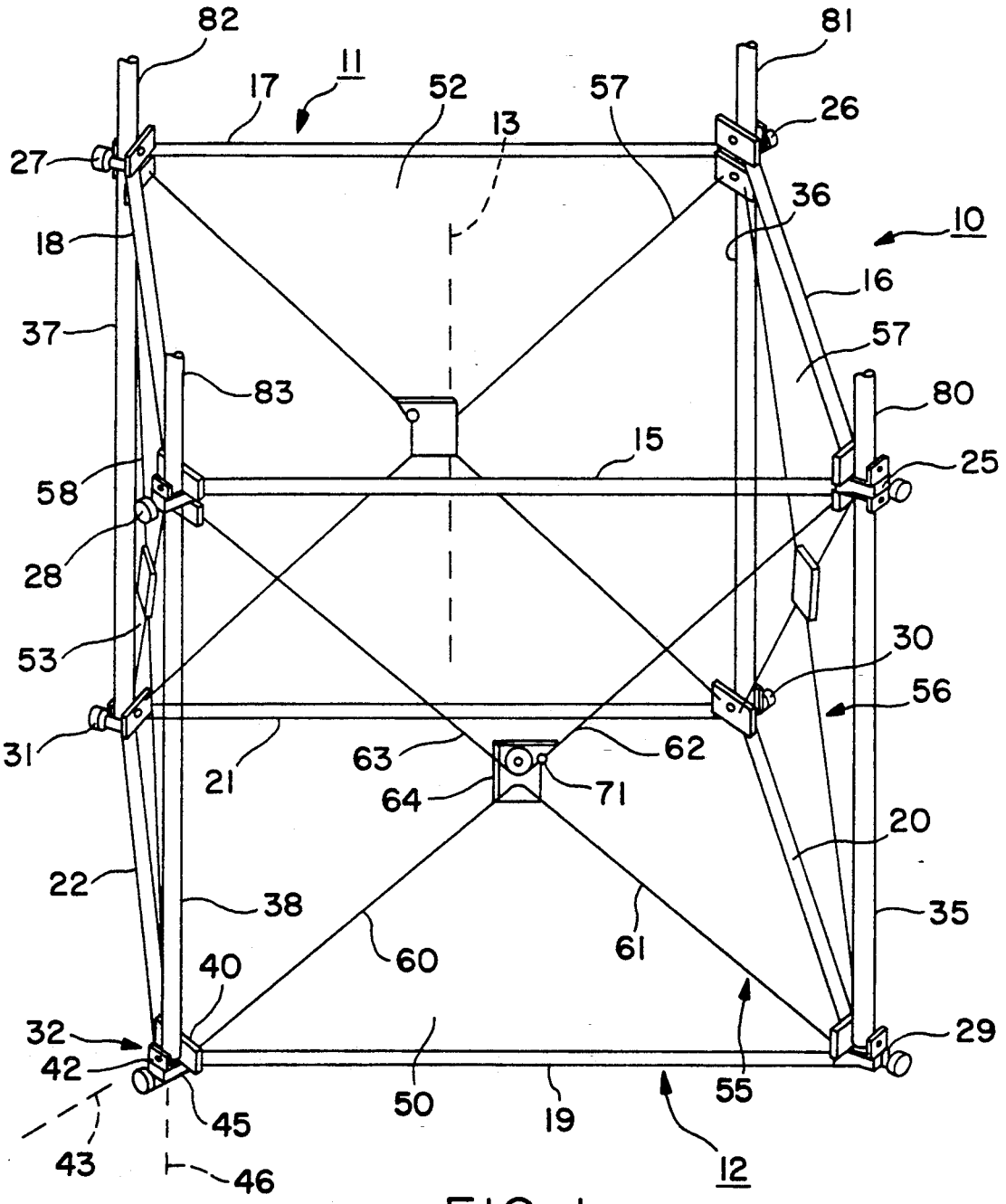
FIG. 1 is a perspective view of a module according to the invention shown in its deployed condition.

FIG. 1 shows a module 10 according to the invention. It includes a first station element 11 and a second station element 12. These are axially spaced apart along an axis 13 of extension when the module is in its extended, deployed condition as shown in FIG. 1.

Station element 11 includes four station rods 15, 16, 17, 18. Station element 12 includes four station rods 19, 20, 21, 22. Adjacent station rods at each corner of the station element are rigidly connected by joints 25, 26, 27, 28 in station element 11, and joints 29, 30, 31, 32 in station 12. Accordingly, both station members are rigid bodies, each forming a regular polygon (usually a square) whose respective planes are normal to axis 13 in the deployed condition. The joints may conveniently be formed as clamps to hold the station rods.

Four rigid longerons 35, 36, 37, 38 extend between and interconnect the station elements. Longeron 35 connects joints 25 and 29; longeron 36, joints 26 and 30; longeron 37, joints 27 and 31; and longeron 38; joints 28 and 32.

All of the joints are identical, so only joint 32 will be described in detail. It includes clamp elements 40 rigidly to hold its two adjacent station rods 19 and 22. Hinge pin 42 has an axis of rotation 43 parallel to the plane of station element 12. Preferably it bisects the angle formed by station rods 19 and 22. Accordingly, longeron 38 can rotate around hinge pin 42.

A second hinge 45 (to which hinge pin 42 is mounted) is rotatable around an axis 46 that is parallel to axis 13.

Now it will be seen that longeron 38 is freely swivelled around joint 32. This enables the longeron to move with motions that will enable it to approach the plane of station element 11, and for it to move angularly to one side of the station element.

When such joints are provided at all intersections, the module can be stowed in an orderly stack in which one station element will have rotated relative to the other as it moves toward it. This obviously is an unstable structure, which must be guided to deploy it and to stow it. What is now needed is a lightweight means to hold the module in its deployed condition by rigidifying the deployed assembly.

When deployed, the planes 50, 51, 52, and 53 bounded by two opposite longerons and two opposite station rods are frequently called "faces" or "bays". To stabilize the structure, diagonal assemblies 55, 56, 57 and 58 are provided respectively in faces 50, 51, 52 and 53. Because all of them are identical in construction and in function, only diagonal assembly 55 will be described in detail.

Diagonal assembly 55 is comprised of four diagonal elements 60, 61, 62, 63. These segments are joined in a very special way at a control 64. The control is located at the intersection of the diagonals. All of these segments are made of an inelastic, flexible material such as steel cable. Segments 60 and 61 are rigidly fixed to control 64, so that their inherent lengths (measured length of the cable) are always equal. As will be seen when the device is stowed, one will collapse and the other will remain stretched, but their inherent lengths are still equal. In fact, segments 60 and 61 can be separate lengths of cable if more convenient.

Segments 62 and 63 are very different. They constitute a single continuous length of cable which is fed through a guide 65. When the module is deployed, segments 62 and 63 are tensioned and equal in actual and inherent length. As will later be seen, when the module is stowed, one or the other of segments 62 or 63 will shorten and the other will lengthen by an equal amount, because cable from one segment will pass through the guide to the other. The lengthened segment, together with segment 60 or 61 as appropriate, will form a longer diagonal which enables the structure to retract. The other two diagonals will relax and slump.

Figure 3:
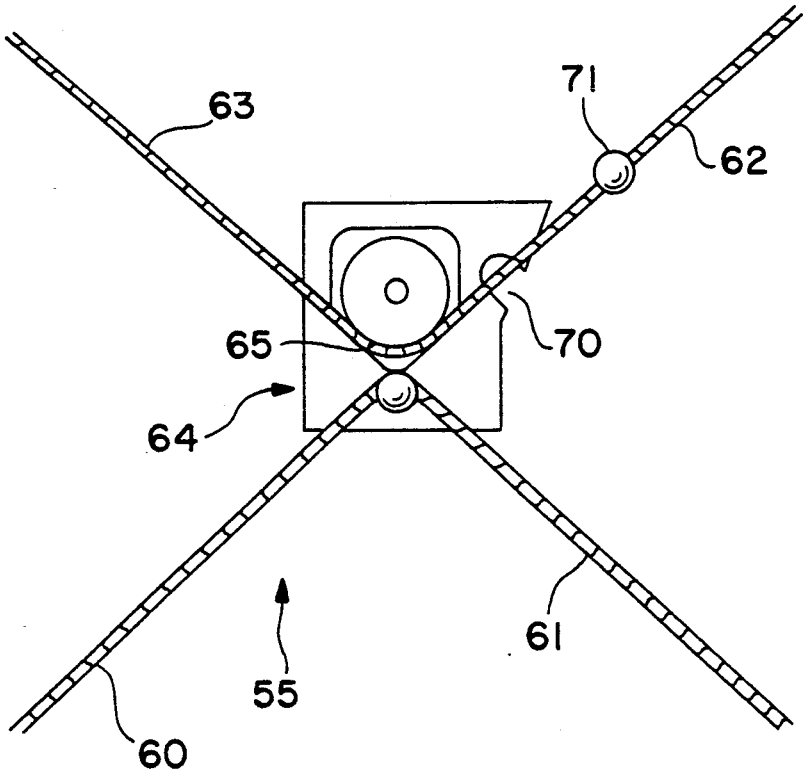
FIG. 3 is a fragmentary side view showing one embodiment of a control means according to the invention.

Further as to the control, in its simplest embodiment (FIG. 3) it includes a catch 70 so disposed and arranged as to trap enlargement 71 on segment 62. When the module is deployed, enlargement 71 is held in catch 70 so segments 62 and 63 are held to exact equality of length. Now the module is firmly held in its deployed condition.

Figure 4:
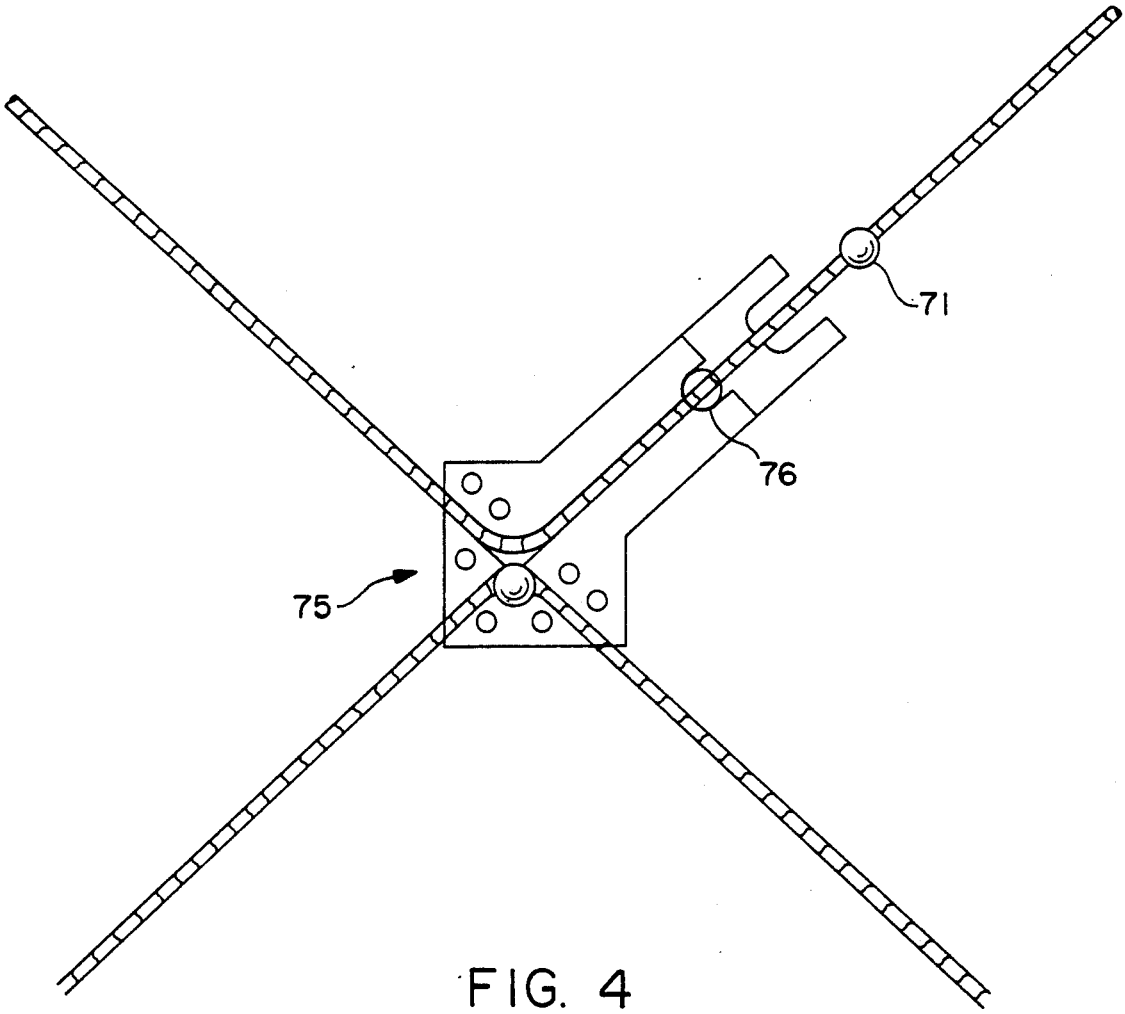
FIG. 4 is a view similar to FIG. 3 showing another embodiment of control means.

FIG. 4 shows another control 75 which can be used in place of control 64. It has a catch 76 formed as a recess to receive enlargement 71. This can be made in a sufficiently springy form that upon appropriate application of force the enlargement can readily be released. In any event, should permanent deployment not be intended, means will be provided to release the control means so as to enable part of segment 62 or 63 to feed into the other segment. All of the faces are similarly provided.

Figure 2:
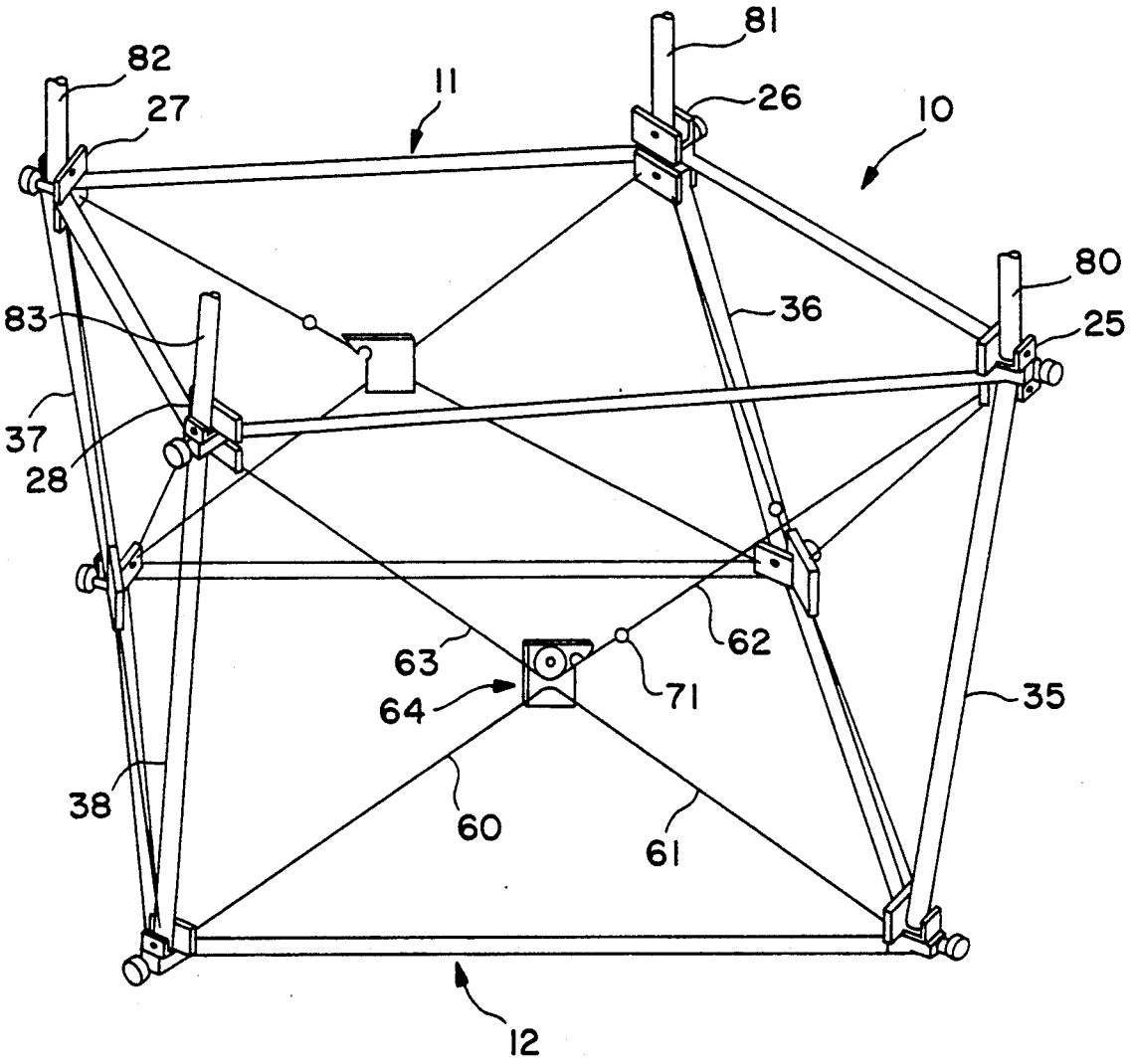
FIG. 2 is a perspective view showing the module of FIG. 1 in a transition position approaching its stowed configuration.

FIG. 2 shows the module partially deployed (or partially stowed). Note that the enlargement has left the catch (or has not arrived at the catch). The diagonal formed by segments 60 and 62 is longer than the diagonal between joints 28 and 29. In fact the cables of segments 61 and 63 will become slack.

The longerons begin to rotate around the two axes of their respective joints, and one station element rotates relative to the other. This movement is reversed to provide either deployment or stowage. When fully stowed, the station elements will approach one another as closely as the structure permits.

Only one module is shown. It can be multiplied to any desired extent by joining others to it. A station element of each will be in common with the next, except for the end modules. For example, portions of longerons 80, 81, 82 and 83 are shown joined to joints 25, 26, 27 and 28, which form the longerons of a next module.

This device can be formed with as few as three bays. Four is the preferred number. More than four can be provided, but this would be unusual.

This invention thereby provides a module, and a mast formed of a plurality of modules, which is stowable, extensible, light of weight, and convenient to use.

This invention is not to be limited by the embodiments shown in the drawings and described in the description which are given by way of example and not of limitation, but only in accordance with the scope of the appended claims.

I claim:

1. A module for forming part of an articulated mast, said mast when deployed having a central axis of extension and a plurality of said modules, each of said modules comprising:

a first and a second station element, each said station element comprising at least three rigid non-folding station rods joined at their ends to form a rigid station, each having respective corners;

an equal number of rigid non-folding longerons, each said longeron being hingedly connected at each end to a corner of said first and second station elements thereby forming between the station members an equal number of bays, the lengths of the longerons and station rods being invariable;

in each bay there being four diagonal segments, each segment extending from a respective corner to the center of the respective bay when deployed, each segment comprising a length of inelastic flexible cable;

and diagonal control means joining the diagonal segments at their intersections; a first pair of two adjacent ones of said segments extending from adjacent corners to the center and fixed to the control means, whereby their inherent lengths remain constant at all conditions of the module, the other pair of two segments being formed as a continuous cable which passes through said control means, said control including catch means which engages said second pair of segments to hold them against passage through the control means when the module is deployed with its longerons normal to the plane of both of the station elements, thereby to hold the module in the deployed condition, and releasably to permit the lengths of said second pair to change when the station elements are brought toward one another, the catch means when released permitting cable from one of said segments of said second pair to pass through the control means to form part of the other segment of said second pair, and preventing it when it engages said cable.

2. A module according to claim 1 in which a joint joins together each adjacent pair of station rods in each station element, and further pivotally mounts a respective end of a respective longeron for pivoting movement around an axis parallel to the plane of its station element, and also for pivoting movement around another axis parallel to said central axis.

3. A module according to claim 1 in which each station element is an equilateral shape.

4. A mast comprising a plurality of modules according to claim 1 in which at least one station element is common to two contiguous modules.

5. A mast according to claim 4 in which a joint joins together each adjacent pair of station rods in each station element, and further pivotally mounts a respective end of a respective longeron for pivoting movement around an axis parallel to the plane of its station element, and also around another axis parallel to said central axis.

* * * * *